United States Patent [19]

Johnston et al.

[11] Patent Number: 4,539,860

[45] Date of Patent: Sep. 10, 1985

[54] PUSHBUTTON INTERLOCK

[75] Inventors: Robert J. Johnston, Patterson Heights; Stephen G. Layciak, Brighton Township, Beaver County; Dominic Colista, Ambridge, all of Pa.

[73] Assignee: Westinghouse Electric Corp., Pittsburgh, Pa.

[21] Appl. No.: 526,713

[22] Filed: Aug. 26, 1983

[51] Int. Cl.[3] ..... G05G 11/00

[52] U.S. Cl. ..... 74/483 PB; 200/5 EA; 200/50 C

[58] Field of Search ..... 74/483 PB; 200/5 B, 200/5 E, 5 EA, 50 C

[56] References Cited

U.S. PATENT DOCUMENTS 1,699,172 1/1929 Weiland ..... 200/5 E
2,295,518 9/1942 Meuer ..... 200/5 B
3,225,153 12/1965 Carling ..... 200/50 C
3,978,298 8/1976 Fukuda et al. ..... 200/5 B

FOREIGN PATENT DOCUMENTS 1091773 10/1960 Fed. Rep. of Germany .
607670 9/1948 United Kingdom .

*Primary Examiner*—Ronald C. Capossela
*Attorney, Agent, or Firm*—L. P. Johns

[57] ABSTRACT

A unique interlock mechanism for two pushbuttons or other linearly operated devices, requiring no mechanical linkages or complex assemblies. The interlock mechanism essentially comprises an interlock member having first and second restraining portions disposed within a housing so that when one of the pushbuttons is operated, the interlock member rotates positioning itself under the second pushbutton, interfering with and making it impossible to be operated.

2 Claims, 3 Drawing Figures

PUSHBUTTON INTERLOCK

BACKGROUND OF THE INVENTION

1. Field of the Invention

The invention relates in general to a pushbutton device for controlling electric apparatus and in particular to an interlock mechanism for dual or multiple linearly operated operators, of which a pushbutton device is a common example.

2. Description of the Prior Art

Interlock mechanisms for interlocking two pushbuttons are well known in the prior art. They may require mechanical linkages or complex assemblies. In addition, interlock devices of the prior art, if they are sized large enough to prevent breakage or mechanical damage when subjected to actuation, generally may cause a problem due to the necessity to accelerate the large mass during actuation of either pushbutton. Conversely, if the interfering member is made lighter to promote ease of actuation, this causes problems with damage to the interfering member by an enthusiastic operator. Accordingly it would be desirable to have an interlock mechanism requiring no mechanical linkages or complex assemblies, and it would further be desirable for the interfering portion of the interlock mechanism to have a small relative mass which actuates an interfering portion of great strength smoothly and provides the essential function of making it impossible to actuate both operators concurrently.

SUMMARY OF THE INVENTION

In accordance with the present invention, an interlock mechanism for linearly operated operators, which may be standard pushbuttons, is provided including an interlock member having first and second restraining portions disposed within a housing, and means for rotating the interlock member with respect to the housing when one of the operators is operated, to cause one of the first and second restraining portions to come in contact with some portion of the other of the operators, so as to prevent simultaneous operation of both operators. The interlock member includes first and second arcuate surface portions and the housing has complementary first and second arcuate surface portions, the interlock member being disposed within the housing so that the complementary first arcuate surface portions of the interlock member and the housing respectively are rotatably engaged, and so that the second complementary arcuate surface portions of the interlock member and the housing respectively are rotatably engaged. The first and second rotatably engaged arcuate surface portions of the interlock member and the housing, respectively, provide a means for rotating the interlock member with respect to the housing. One of the first and second restraining portions comes in contact and rigidly restrains movement of some portion of one of the operators when the other operator has been operated. The portion of the operated operator that comes in contact with one of the first and second restraining portions of the interlock member causes the interlock member to rotate along the complementary arcuate surfaces of the interlock member and the housing, such that the other of the first and second restraining portions rigidly engages some portion of the other of the operators. The interlock mechanism of the present invention provides a unique way to interlock two pushbuttons or other linear operated operators. It requires complex mechanical assemblies. Essentially, the interlock member is shaped by two arcs subtending angles of rotation formed by concentric radii; one radius considerably larger than the other as will be illustrated in the drawings. When sandwiched between two stationary surfaces, the inner (smaller) radius is free to rotate between two "pushbuttons", while the arcs of the second radius (larger) come in contact with the flange areas of the pushbuttons as will be illustrated in the drawings. The length of the second radius is sized, so that when one of the buttons is pushed down, the interlock member rotates, positioning one of the second radius' arcs under the second pushbutton operator, interfering with, and making it impossible to push the second operator down. Thus the two buttons are interlocked by this one unique interlock member according to the teachings of the invention.

BRIEF DESCRIPTION OF THE DRAWINGS

The invention may be understood, and further advantages and uses thereof more readily apparent, when considered in view of the following detailed description of exemplary embodiments, taken with the accompanying drawings in which.

DESCRIPTION OF THE PREFERRED EMBODIMENT

Figure 1:
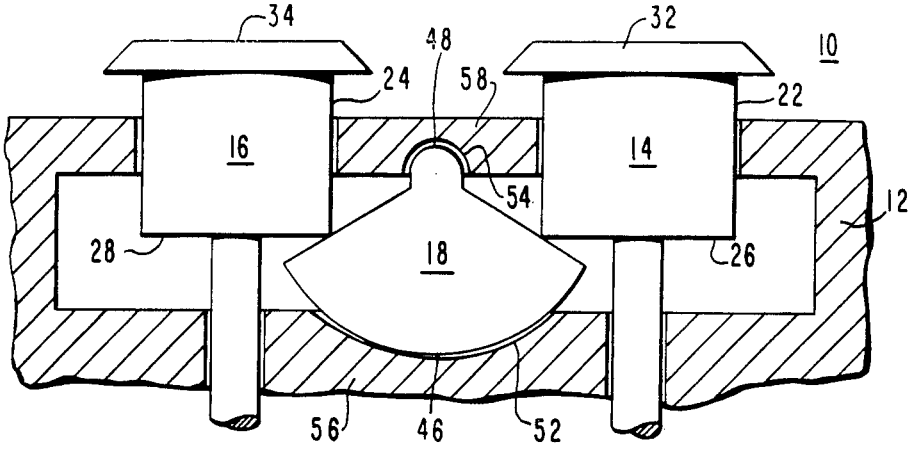
FIG. 1 is a longitudinal section through a dual pushbutton mechanism, constructed according to the teachings of the invention, showing both operators in the pulled out position.

Throughout this description, like elements will be identified with like numerals. Referring now to the drawings and to FIG. 1 in particular, there is shown a longitudinal section through a dual linearly operated pushbutton mechanism, constructed according to the teachings of the invention. Pushbutton mechanism 10 includes housing 12 which may be secured to a control panel (not shown), first and second linear operated operators or pushbuttons 14 and 16 respectively and interlock member 18. First and second linearly operated operators or pushbuttons 14 and 16 respectively include first and second pushbutton bodies 22 and 24 having first and second contact or flange portions 26 and 28 respectively and first and second pushbutton heads 32 and 34 respectively, of generally mushroom shape, being secured to pushbutton bodies 22 and 24 usually by means of a threaded arrangement (not shown).

Figure 2:
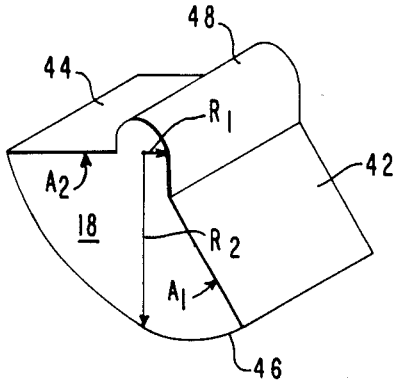
FIG. 2 is an enlarged detailed view of the interlock member of FIGS. 1 and 2.
Figure 3:
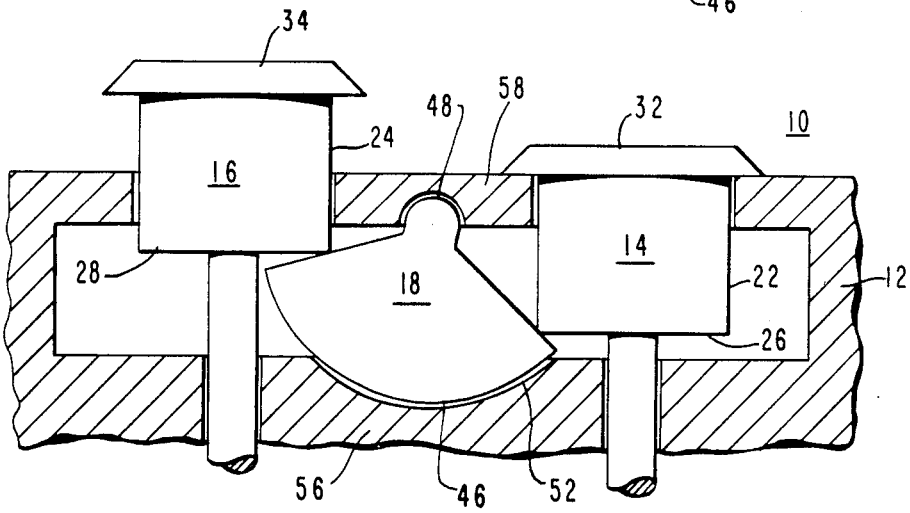
FIG. 3 is the pushbutton mechanism of FIG. 1 showing one of the operators or pushbuttons in the depressed position with the interlock member rotated so as to interfere with and make it impossible to operate the second operator.

Referring now to FIG. 2 there is shown an enlarged detailed view of interlock member 18, constructed according to the teachings of the invention. Interlock member 18 includes first and second contact or restraining portions 42 and 44 respectively and first and second arcuate surface portions 46 and 48 respectively. Contact or restraining portions 42 and 44 respectively are shaped by two arcs A1 and A2 respectively subtending angles of rotation formed by concentric radii R1 and R2 respectively, radius R2 being considerably larger than radius R1. When sandwiched between two stationary surfaces, for instance complementary first and second arcuate surface portion 52 and 54 of seat 56 and cover 58 respectively of housing 12 (FIGS. 1 and 3), the inner (smaller) radius R1 and outer (larger) radius R2 are free to rotate, while the contact or restraining portions 42 and 44 respectively, formed by arcs A1 and A2, of the larger radius R2, respectively, come in contact with the contact or flange portions 26 and 28 of the first or second pushbuttons or operators 14 and 16 respectively. The second radius R2 is sized to a predetermined length such that the length of the arcs A1 and A2 respectively is of sufficient size, so that when one of the operators or pushbuttons is pushed down, the interlock member 18 rotates, due to the contact with the bottom contact or flange area of the depressed pushbutton with one of contact/restraining portions 42, 44 of interlock member 18, positioning the remaining contact or restraining portions 42, 44 under the second pushbutton or operator flange area, interfering with, and making it impossible to push the second operator or pushbutton down or at least impossible to depress both pushbuttons simultaneously (FIG. 3). Thus the two operators or pushbuttons are interlocked by this one unique rotating interlock member.

Referring now to FIG. 3, in operation, when as illustrated pushbutton 14 is depressed, bottom contact or flange area 26 of pushbutton 14 comes in contact with contact/restraining portion 42 of interlock member 18, rotating interlock member 18 in the clockwise direction and positioning contact/restraining portion 44 of interlock member 18 under contact or flange area 28 of pushbutton 16, thereby interfering with and restraining movement of pushbutton 16. If pushbutton 16 would be manually depressed, bottom contact or flange area 28 of pushbutton 16 would actuate interlock member 18 in the counterclockwise direction, wherein contact/restraining portion 42 of interlock member 18 would force pushbutton 14 upward by means of bottom contact or flange area 26 of pushbutton 14. From this description of operation it can be seen that it is impossible to depress both pushbuttons simultaneously.

The advantages of an interlock member of this design are that the interlock member itself may be sized large enough through the contact/restraining portions 42 and 44, formed by arc A1 and A2 respectively, so that contact/restraining portions 42 and 44 have great strength while allowing interlock member 18 itself to have a relatively small mass to accelerate (rotational acceleration) for ease of trouble free operation.

We claim:

1. A manually operated switch assembly with interlock mechanism, comprising:

a housing having first and second arcuate surface portions at oppositely facing positions;

first and second pushbuttons within the housing;

an interlock in the housing and having complementary first and second arcuate surface portions rotatably engaging the corresponding first and second surface portions of the housing;

the interlock also having one surface engaged by the first pushbutton and another surface engaged by the second pushbutton; and the interlock being rotatable within and between the complementary first and second arcuate surface portions in response to activation of the first pushbutton to block actuation of the other pushbutton.

2. The assembly of claim 1 in which the corresponding first and second arcuate surface portions of the interlock and of the housing have concentric radii and said one and other surfaces of the interlock are each inclined at subtending angles of rotation of the corresponding radii of the interlock.

* * * * *